US011172547B2

(12) United States Patent
Qiu et al.

(10) Patent No.: US 11,172,547 B2
(45) Date of Patent: Nov. 9, 2021

(54) ATOMIZER AND ELECTRONIC CIGARETTE THEREOF

(71) Applicant: Changzhou Patent Electronic Technology Co., LTD, Jiangsu (CN)

(72) Inventors: Weihua Qiu, Jiangsu (CN); Neng Hua, Jiangsu (CN)

(73) Assignee: Changzhou Patent Electronic Technology Co., LTD, Jiangsu (CN)

( * ) Notice: Subject to any disclaimer, the term of this patent is extended or adjusted under 35 U.S.C. 154(b) by 417 days.

(21) Appl. No.: 16/143,177

(22) Filed: Sep. 26, 2018

(65) Prior Publication Data

US 2019/0090543 A1 Mar. 28, 2019

(30) Foreign Application Priority Data

Sep. 27, 2017 (CN) ..... 201710888577.4

(51) Int. Cl.

| | |
|---|---|
| ***H05B 3/42*** | (2006.01) |
| ***H05B 3/24*** | (2006.01) |
| ***A24F 40/46*** | (2020.01) |
| ***A24F 40/485*** | (2020.01) |
| ***A24F 40/20*** | (2020.01) |

(52) U.S. Cl.

CPC ..... *H05B 3/42* (2013.01); *A24F 40/46* (2020.01); *A24F 40/485* (2020.01); *H05B 3/24* (2013.01); *A24F 40/20* (2020.01); *H05B 2203/022* (2013.01)

(58) Field of Classification Search

CPC .... A24F 47/008; H05B 3/24; H05B 2203/022
See application file for complete search history.

(56) References Cited

U.S. PATENT DOCUMENTS

| | | | | |
|---|---|---|---|---|
| 10,561,172 | B2 * | 2/2020 | Armoush | A24F 47/008 |
| 2005/0160989 | A1 * | 7/2005 | Kuibira | H01L 21/67103 118/728 |
| 2008/0149118 | A1 * | 6/2008 | Oglesby | A61M 15/06 131/194 |
| 2014/0109905 | A1 * | 4/2014 | Yamada | A61M 15/06 128/203.27 |
| 2016/0201901 | A1 * | 7/2016 | Sato | H05B 3/50 431/215 |

(Continued)

*Primary Examiner* — Francisco W Tschen
*Assistant Examiner* — Guy F Mongelli
(74) *Attorney, Agent, or Firm* — Novick, Kim & Lee, PLLC; Allen Xue

(57) ABSTRACT

An atomizer and an electronic cigarette are provided. The atomizer comprises an atomizing chamber and a heating assembly, the heating assembly includes heater, the heater is in the form of a sheet, the two opposite sides of the heater form air flow passages, the two opposite side walls of the heater respectively form the side walls of the air flow passages, the air flow passages are in communicate with the atomizing chamber, the number of the heater is at least one. Since the heating assembly located in the air flow passages is configured to heat the air entrance into the air flow passages, so that the air has a higher temperature when it reaches the atomizing chamber. The hot air heats the tobacco, and the contact area between the hot air and the tobacco is more uniform, and the heating can be completed quickly without waiting, generating more smoke and improving the taste.

8 Claims, 9 Drawing Sheets

(56) References Cited

U.S. PATENT DOCUMENTS

| | | | | |
|---|---|---|---|---|
| 2017/0020193 | A1* | 1/2017 | Davis | A61M 11/041 |
| 2017/0105454 | A1* | 4/2017 | Li | A24F 47/008 |
| 2017/0205113 | A1* | 7/2017 | Oohigashi | F28D 1/053 |

* cited by examiner

ATOMIZER AND ELECTRONIC CIGARETTE THEREOF

CROSS-REFERENCE TO RELATED APPLICATIONS

The application claims benefit of Chinese Patent Application No. 20710888577.4, filed on Sep. 27, 2017, entitled "Atomizer and Electronic Cigarette Thereof," which is incorporated herein by reference in its entirety.

FIELD

The present disclosure relates to the field of simulated smoking technology, and more particularly to an atomizer and an electronic cigarette using the same.

BACKGROUND

At present, flue-cured tobacco needs to be pre-heated, and waiting for a long time to generate smoke. Most of the heating methods currently used are direct heating, because the heat used to heat the tobacco away from the heating element needs to be transmitted through the tobacco close to the heating element, so that it is not easy to heat the tobacco evenly. Further, because heat is transferred between the tobaccos, the heating rate cannot be too fast, otherwise the tobacco near the heating element will be burnt, but the tobacco away from the heating element is not heated enough, which will affect the user's suction taste.

SUMMARY

The present disclosure provides an atomizer for heating tobacco with hot air and an electronic cigarette thereof.

An atomizer, includes an atomizing chamber, and a heating assembly, the heating assembly comprises a heater, the heater is in the form of a sheet, the two opposite sides of the heater form air flow passages, the two opposite side walls of the heater respectively form the side walls of the air flow passages, the air flow passages are in communication with the atomizing chamber, the number of the heater is at least one.

In an embodiment, the atomizer further includes an air guiding assembly, the air flow passages constitute by the air guiding assembly and the heater, the air guiding assembly includes first air guiding members and second air guiding member, the number of the first air guiding members is two, the number of the second air guiding members is one less than the heaters.

In an embodiment, when the number of the heater is one, the first air guiding members are respectively located at the two opposite sides of the heater, the air flow passage comprise two first air flow passages, the air guiding members cooperate with the corresponding sides of the heater to form the first air flow passages.

In an embodiment, the number of the heaters is larger than two, the heater and the second air guiding member are arranged alternately, and the first air guiding members are respectively disposed at the outermost of one of the heaters, the air flow passage includes first air flow passage and second air flow passage, the number of the first air flow passage is two, the second air flow passages is twice the number of the second air guiding member members, the first air guiding members respectively cooperate with the corresponding side surfaces of the heater to form the first air flow passages, the second air guiding members respectively cooperate with the corresponding side surfaces of the heater to form the second air flow passages.

In an embodiment, the first air guiding member includes a substrate, a first side plate and a second side plate respectively disposed on the substrate, the first side plate extends toward the second side plate to form at least two first partitions, there is a gap formed between the first partition and the second side plate, the second side plate extends toward the first side plate to form at least two second partition plates, there is a gap formed between the second partition and the first side plates, the first partition and the second partition are alternately arranged, the first air flow passage is formed by the first side plate, the second side plate, the first partition, the second partition and corresponding sides of the heater.

In an embodiment, the gap between the second side plate and the lowermost first partition located at the first air guiding member forms a first air inlet, or the gap between the lowermost second partition located at the first air guiding member and the first side plate forms a first air inlet; the gap between the uppermost first partition and the second side plate forms a first air outlet, or the gap between the uppermost second partition and the first side plate forms a first air outlet.

In an embodiment, the second air guiding member includes a first backing plate and a second backing plate, there is a connecting plate located between the first backing plate and the second backing plate, the portions of the first backing plate located at the two sides of the connecting plate extend toward the second backing plate to form at least two first wall plates, each of the first wall plates and the second backing plate have a gap therebetween, the portions of the second backing plate located at the two sides of the connecting plate extend toward the first backing plate to form at least two second wall plates, each of the second wall plate and the first backing plate have a gap therebetween, and the first wall plate and the second wall plate are alternately arranged; the second air inlet is formed by the first backing plate, the second backing plate, the first wall plate, the second wall plate, and corresponding sides of the heater.

In an embodiment, the gap between the lowermost first wall plates and the second backing plate forms the second air inlet, or the gap between the lowermost second wall and the first backing plate forms the second air inlet; the gap between the uppermost first wall plate and the second backing plate forms the second air outlet, or the gap between the uppermost second wall and the first backing plate forms the second air outlet.

In an embodiment, the heater includes a heating element and a thermal conductor wrapped around the heating element, the thermal conductor is made of silicon nitride or aluminum nitride, the heating element is made of tungsten slurry.

A electronic cigarette includes an atomizer, the atomizer includes an atomizing chamber and a heating assembly, the heating assembly includes heater, the heater is in the form of a sheet, the two opposite sides of the heater form air flow passages, the two opposite side walls of the heater respectively form the side walls of the air flow passages, the air flow passages are in communicate with the atomizing chamber, the number of the heater is at least one.

In an embodiment, the atomizer further includes an air guiding assembly, the air flow passages constitute by the air guiding assembly and the heater, the air guiding assembly includes first air guiding members and second air guiding member, the number of the first air guiding members is two, the number of the second air guiding members is one less than the heaters.

In an embodiment, when the number of the heater is one, the first air guiding members are respectively located at the two opposite sides of the heater, the air flow passage comprise two first air flow passages, the air guiding members cooperate with the corresponding sides of the heater to form the first air flow passages.

In an embodiment, when the number of the heaters is larger than two, the heaters and the second air guiding member are arranged alternately, and the first air guiding members are respectively disposed at the outermost of one of the heaters, the air flow passage includes first air flow passage and second air flow passage, the number of the first air flow passage is two, the second air flow passages is twice the number of the second air guiding member members, the first air guiding members respectively cooperate with the corresponding side surfaces of the heater to form the first air flow passages, the second air guiding members respectively cooperate with the corresponding side surfaces of the heater to form the second air flow passages.

In an embodiment, the first air guiding member includes a substrate, a first side plate and a second side plate respectively disposed on the substrate, the first side plate extends toward the second side plate to form at least two first partitions, there is a gap formed between the first partition and the second side plate, the second side plate extends toward the first side plate to form at least two second partition plates, there is a gap formed between the second partition and the first side plates, the first partition and the second partition are alternately arranged, the first air flow passage is formed by the first side plate, the second side plate, the first partition, the second partition and corresponding sides of the heater.

In an embodiment, the second air guiding member includes a first backing plate and a second backing plate, there is a connecting plate located between the first backing plate and the second backing plate, the portions of the first backing plate located at the two sides of the connecting plate extend toward the second backing plate to form at least two first wall plates, each of the first wall plates and the second backing plate have a gap therebetween, the portions of the second backing plate located at the two sides of the connecting plate extend toward the first backing plate to form at least two second wall plates, each of the second wall plate and the first backing plate have a gap therebetween, and the first wall plate and the second wall plate are alternately arranged; the second air inlet is formed by the first backing plate, the second backing plate, the first wall plate, the second wall plate, and corresponding sides of the heater.

An atomizer includes a housing, the housing defines an atomizing chamber therein, an air guiding assembly received in the housing, the air guiding assembly includes air flow passages in communicates with the atomizing chamber, a heating assembly comprising a heater located in the air flow passages, and a heat insulator located between the housing and the air guiding assembly, the number of the heater is at least one.

In an embodiment, the atomizer further includes an air guiding assembly, the air guiding assembly includes first air guiding members and second air guiding member, the number of the first air guiding members is two, the number of the second air guiding members is one less than the heaters, the heater and the second air guiding member are arranged alternately, the first air guiding members are respectively disposed at the outermost of one of the heaters, the heat insulator is sleeved outside of the first air guiding member, to clamp the heater between the first air guiding member and the second air guiding member.

In an embodiment, the air flow passage includes first air flow passage and second air flow passage, the number of the first air flow passage is two, the second air flow passages is twice, the number of the second air guiding member members, the first air guiding members respectively cooperate with the corresponding side surfaces of the heater to form the first air flow passages, the second air guiding members respectively cooperate with the corresponding side surfaces of the heater to form the second air flow passages.

In an embodiment, the first air guiding member includes a substrate, a first side plate and a second side plate respectively disposed on the substrate, the first side plate extends toward the second side plate to form at least two first partitions, there is a gap formed between the first partition and the second side plate, the second side plate extends toward the first side plate to form at least two second partition plates, there is a gap formed between the second partition and the first side plates, the first partition and the second partition are alternately arranged, the first air flow passage is formed by the first side plate, the second side plate, the first partition, the second partition and corresponding sides of the heater.

In an embodiment, the second air guiding member includes a first backing plate and a second backing plate, there is a connecting plate located between the first backing plate and the second backing plate, the portions of the first backing plate located at the two sides of the connecting plate extend toward the second backing plate to form at least two first wall plates, each of the first wall plates and the second backing plate have a gap therebetween, the portions of the second backing plate located at the two sides of the connecting plate extend toward the first backing plate to form at least two second wall plates, each of the second wall plate and the first backing plate have a gap therebetween, and the first wall plate and the second wall plate are alternately arranged; the second air inlet is formed by the first backing plate, the second backing plate, the first wall plate, the second wall plate, and corresponding sides of the heater The beneficial effects of the utility model are:

Since the heating assembly located in the air flow passages is configured to heat the air entrance into the air flow passages, so that the air has a higher temperature when it reaches the atomizing chamber. The hot air heats the tobacco, and the contact area between the hot air and the tobacco is more uniform, and the heating can be completed quickly without waiting, generating more smoke and improving the taste.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

Figure 1:
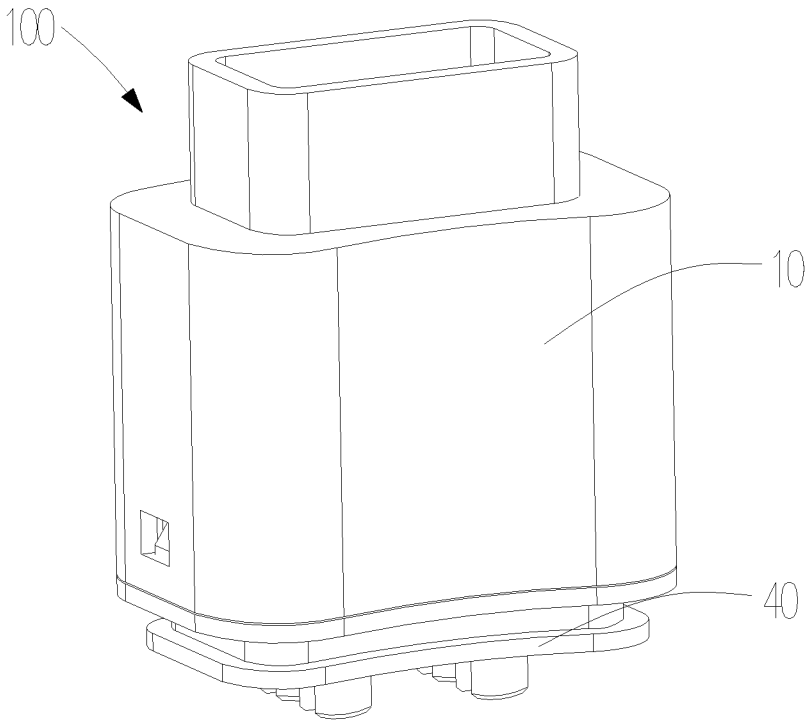
FIG. 1 is a perspective view of an atomizer of the present disclosure.

The following table list various components and reference numerals thereof.

| | | |
|---|---|---|
| Atomizer 100 | Housing 10 | Atomizing chamber 11 |
| Heat insulator 12 | Latching slot 13 | Air guiding assembly 20 |
| First air guiding member 21 | Substrate 211 | First side plate 212 |
| First partition 2121 | Second side plate 213 | Second partition 2131 |
| First air flow passage 214 | First air inlet 2141 | First air outlet 2142 |
| Second air guiding member 22 | First backing plate 221 | First wall plate 2211 |
| Second backing plate 222 | Second wall plate 2221 | Connecting plate 223 |
| Installation groove 2231 | Second air flow passage 224 | Second air inlet 2241 |
| Second air outlet 2242 | Air guiding plate 23 | Air guiding hole 231 |
| Heating assembly 30 | Heater 31 | Heating element 311 |
| Thermal conductor 312 | Electrode contact 32 | Base 40 |
| Locking member 41 | Air intake hole 42 | First mounting hole 43 |
| Second mounting hole 44 | Temperature sensor 5 | |

DETAILED DESCRIPTION OF PREFERRED EMBODIMENTS

The specific embodiments of the present disclosure will be described in detail below with reference to the accompanying drawings. It should be understood that the specific embodiments described herein are only used to illustrate and explain the present disclosure and are not intended to limit the present disclosure.

Figure 2:
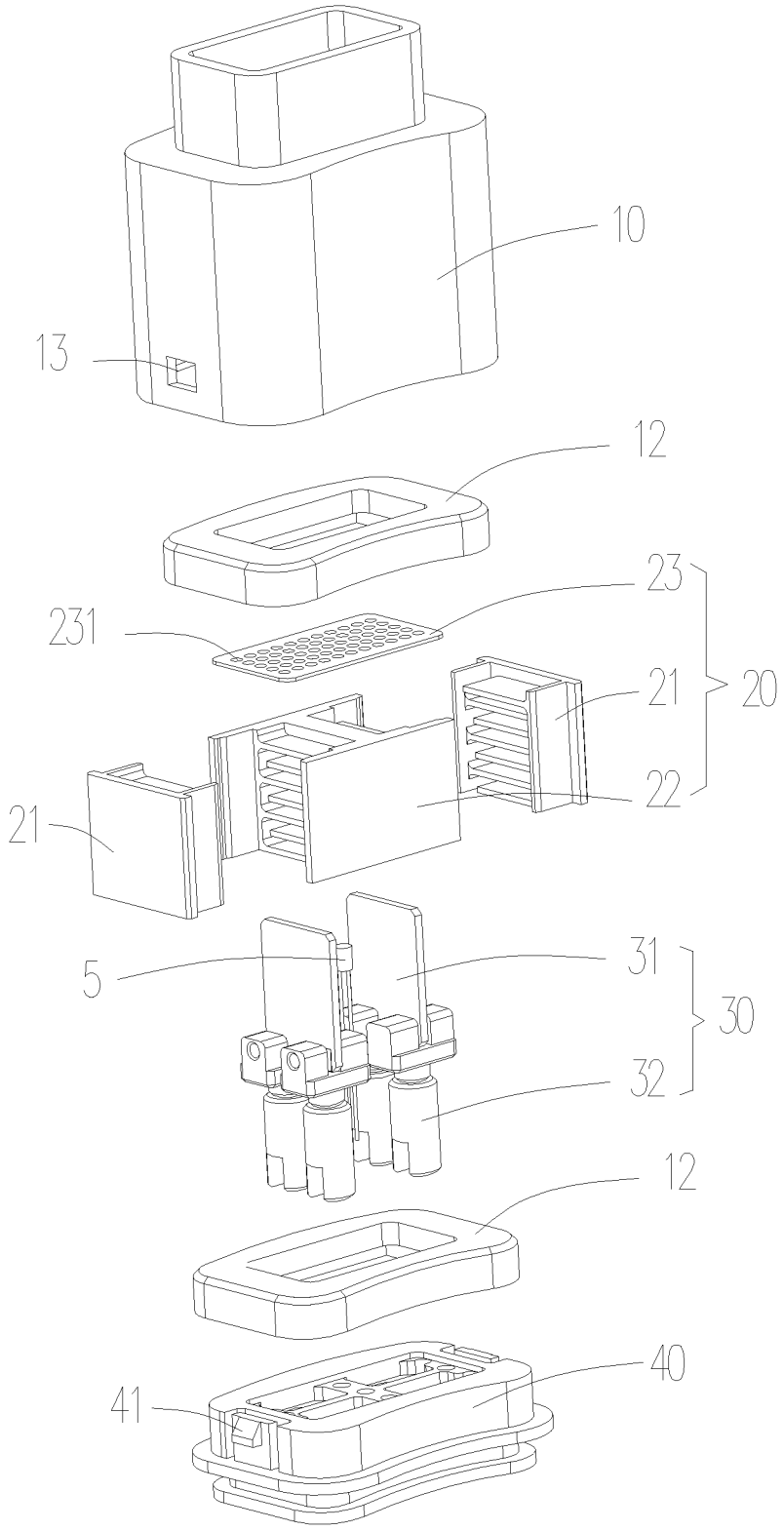
FIG. 2 is an exploded view of the atomizer of FIG. 1.

As shown in FIG. 1 and FIG. 2, the present disclosure provides an electronic cigarette, the electronic cigarette includes an atomizer 100 and a battery assembly (not shown) electrically connected to the atomizer 100. The atomizer 100 includes a housing 10, a base 40 disposed at one end of the housing 10, an air guiding assembly 20 and a heating assembly 30 received within the housing 10.

The housing 10 has a stepped cylindrical structure with two opposite open ends, the inner cavity of the housing 10 is divided into an upper cavity and a lower cavity. The upper cavity of the housing 10 forms an atomizing chamber 11, and the air guiding assembly 20 is received in the lower cavity of the housing 10. A heat insulator 12 is disposed in the lower cavity of the housing 10, the heat insulator 12 has a ring shape. The heat insulator 12 is sleeved outside of the air guiding assembly 20 to form a gap between the air guiding assembly 20 and the housing 10. On the one hand, the heat insulator 12 has the function of heat insulation itself. On the other hand, the gap between the air guiding assembly 20 and the housing 10 can greatly reduce heat transfer between the air guiding assembly 20 and the housing 10, thus, the heat generated by the heating assembly 30 can be sufficient to heat the air within the air guiding assembly 20. In addition, the heat insulator 12 is further configured to fix the air guiding assembly 20. In the this embodiment, two heat insulators 12 are disposed inside the housing 10, and the heat insulators 12 are respectively disposed at the upper end and the lower end of the air guiding assembly 20. The heat insulator 12 is made of heat insulating material, for example, high temperature resistant silicone.

The air guiding assembly 20 includes two first air guiding members 21, a second air guiding member 22 and an air guiding plate 23, the first air guiding members 21 are symmetrically disposed on two opposite sides of the second air guiding member 22, the air guiding plate 23 is disposed on the second air guiding member 22.

Figure 3:
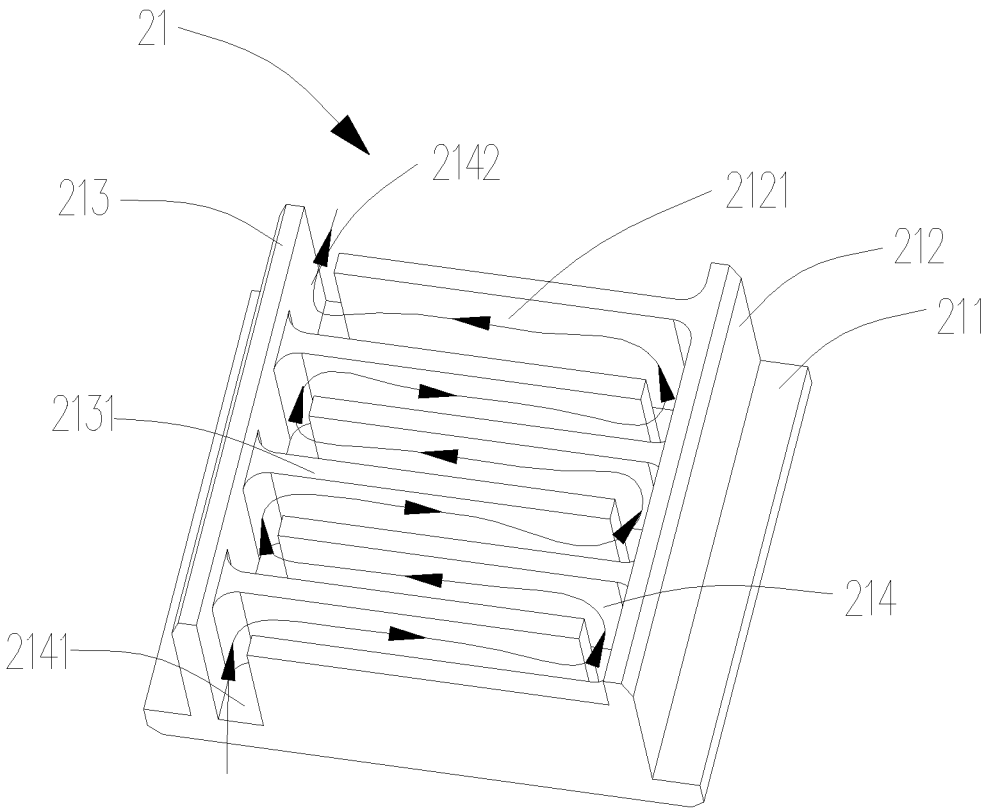
FIG. 3 is a perspective view of the first air guiding member of FIG. 2.
Figure 7:
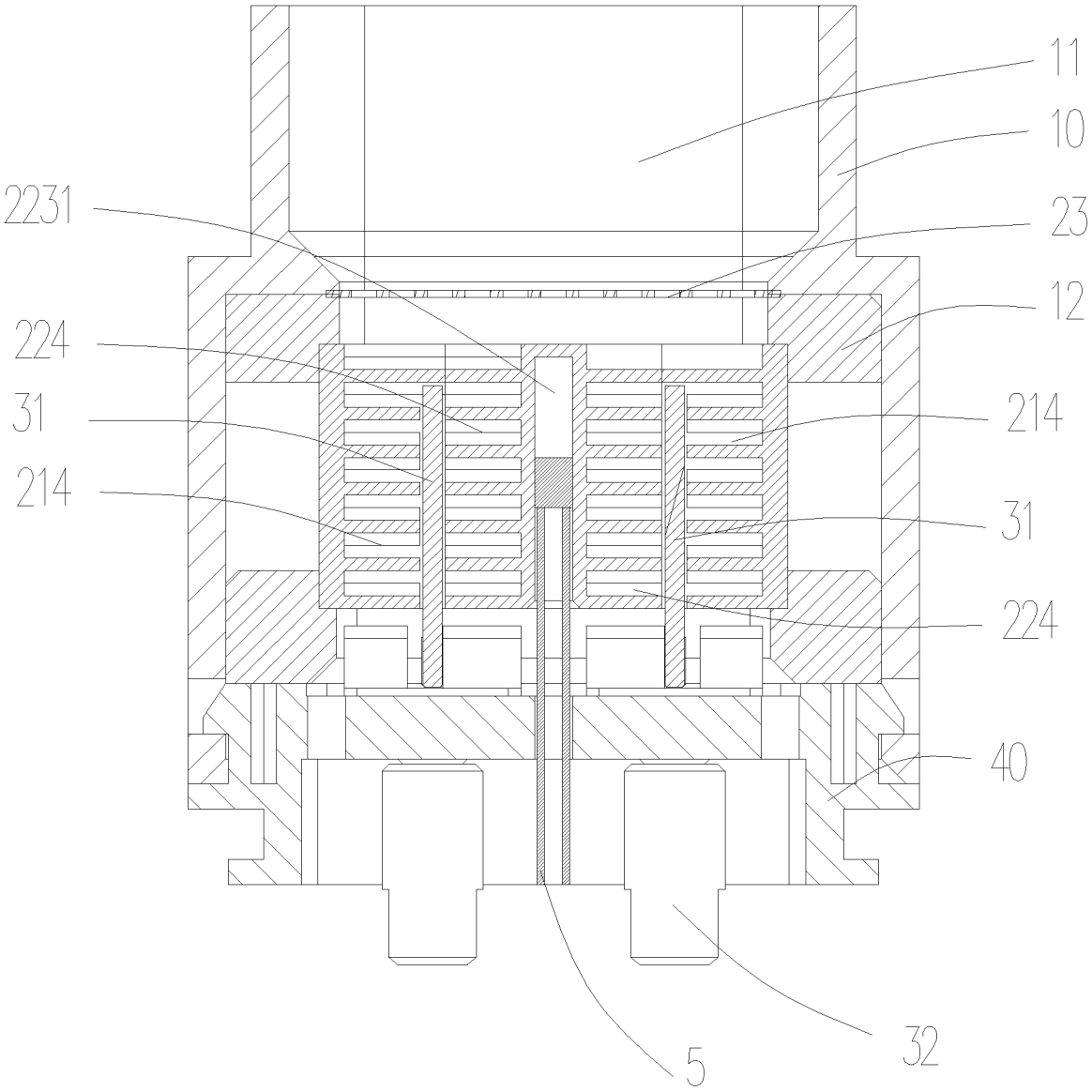
FIG. 7 is a cross-sectional view of the atomizer of FIG. 1.

Referring to FIG. 3 and FIG. 7, the first air guiding member 21 includes a substrate 211 corresponding to the second air guiding member 22, a first side plate 212 and a second side plate 213 respectively disposed on opposite sides of the substrate 211. The first side plate 212 and the second side plate 213 are both disposed toward the second air guiding member 22, the first side plate 212 extends toward the second side plate 213 to form at least two first partitions 2112, there is a gap formed between the first partition 2121 and the second side plate 213. The second side plate 213 extends toward the first side plate 212 to form at least two second partition plates 2131, there is a gap formed between the second partition 2131 and the first side plates 212. The first partition 2121 and the second partition 2131 are alternately arranged, and the second partition 2131 and the first partition 2121 adjacent to the second partition 2131 forms a gap therebetween, that is, the second partition 2131 and the first partition 2121 are spaced apart from one another. The first side plate 212, the second side plate 213, the first partition 2121 and the second partition 2131 constitute a first air flow passage 214.

The gap between the second side plate 213 and the lowermost first partition 2121 located at the first air guiding member 21 forms a first air inlet 2141, or the gap between the lowermost second partition 2131 located at the first air guiding member 21 and the first side plate 212 forms a first air inlet 2141; the gap between the uppermost first partition 2121 and the second side plate 213 forms a first air outlet 2142, or the gap between the uppermost second partition 2131 and the first side plate 212 forms a first air outlet 2142.

Figure 4:
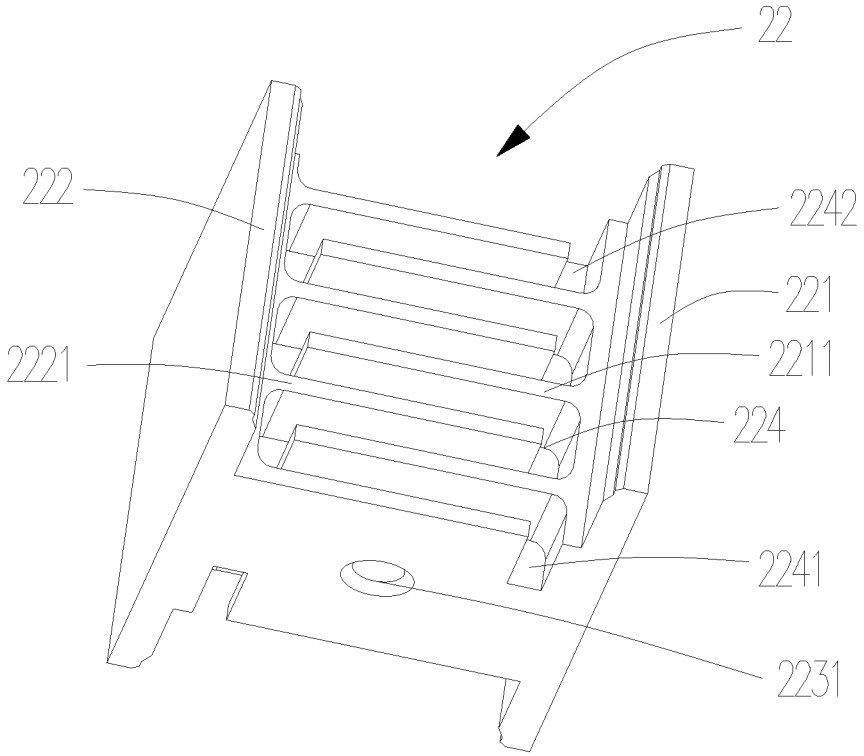
FIG. 4 is a perspective view of the second air guiding member of FIG. 2.
Figure 5:
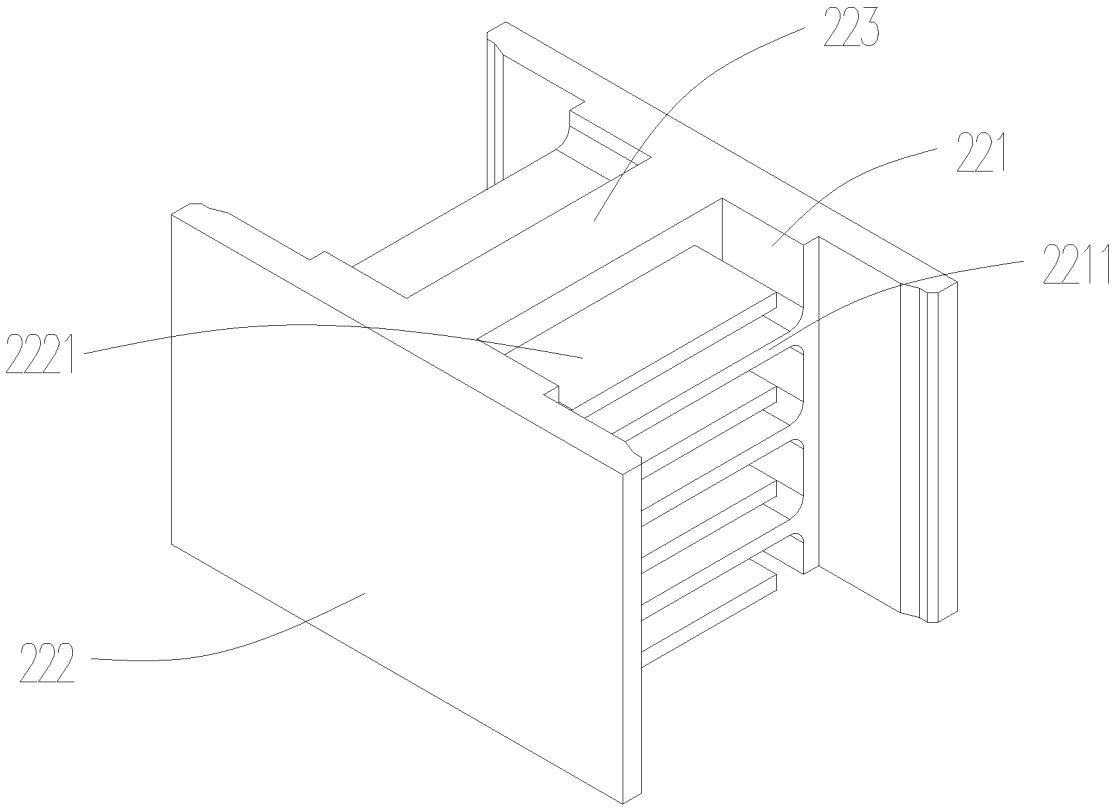
FIG. 5 is another perspective view of the second air guiding member of FIG. 4.

Referring to FIG. 4 and FIG. 5, the second air guiding member 22 includes a first backing plate 221, a second backing plate 222 and a connecting plate 223. The connecting plate 223 is located between the first backing plate 221 and the second backing plate 222, and connects the first backing plate 221 and the second backing plate 222 together. In the embodiment, one end of the connecting plate 223 connects the first backing plate 221, and the opposite end of the connecting plate 223 connects the second backing plate 222. The portions of the first backing plate 221 located at the two sides of the connecting plate 223 extend toward the second backing plate 222 to form at least two first wall plates 2211. Each of the first wall plates 2211 and the second backing plate 222 have a gap therebetween. The portions of the second backing plate 222 located at the two sides of the connecting plate 223 extend toward the first backing plate 221 to form at least two second wall plates 2221. Each of the second wall plate 2221 and the first backing plate 221 have a gap therebetween, and the first wall plate 2211 and the second wall plate 2221 are alternately arranged. The first backing plate 221, the second backing plate 222, the first wall plate 2211 and the second wall plate 2221 form two second air flow passages 224 respectively located at the two opposite sides of the connecting plate 223, and the gap between the lowermost first wall plate 2211 and the second backing plate 222 forms a second air inlet 2241, or the gap between the lowermost second wall plate 2221 and the first backing plate 221 forms a second air inlet 2241; the gap between the uppermost first wall plate 2211 and the second backing plate 222 forms a second air outlet 2242, or the gap between the uppermost second wall plate 2221 and the first backing plate 221 forms a second air outlet 2242.

The connecting plate 223 defines an installation groove 2231 passing through the bottom of connecting plate 223, a temperature sensor 5 is disposed in the installation groove 2231.

It can be appreciated that, in other embodiments not shown, the second air guiding member 22 can be composed of two first air guiding members 21, and the substrates 211 of the two first air guiding members 21 abut against each other to form second air guiding members 22.

The air guiding plate 23 is disposed in the housing 10, and the outer peripheral surface of the air guiding plate 23 abuts against the inner wall of the housing 10 to isolate the atomizing chamber 11 from the lower cavity of the housing 10. The air guiding plate 23 defines an air guiding hole 231, the first air outlet 2142 and the second air outlet 2242 is in communicate with the atomizing chamber 11 via the air guiding hole 231. Further, the air guiding plate 23 constitutes the bottom wall of the atomizing chamber 11, and the tobacco placed in the atomizing chamber 11 can be carried by the air guiding plate 23. Therefore, to prevent tobacco from falling into the lower cavity of the housing 10 through the air guiding holes 231, the air guiding hole 231 has a small aperture. The air guiding holes 231 are evenly defined on the air guiding plate 23, so that the hot air can uniformly flow into the atomizing chamber 11, thereby uniformly heating the tobacco received in the atomizing chamber 11.

Figure 8:
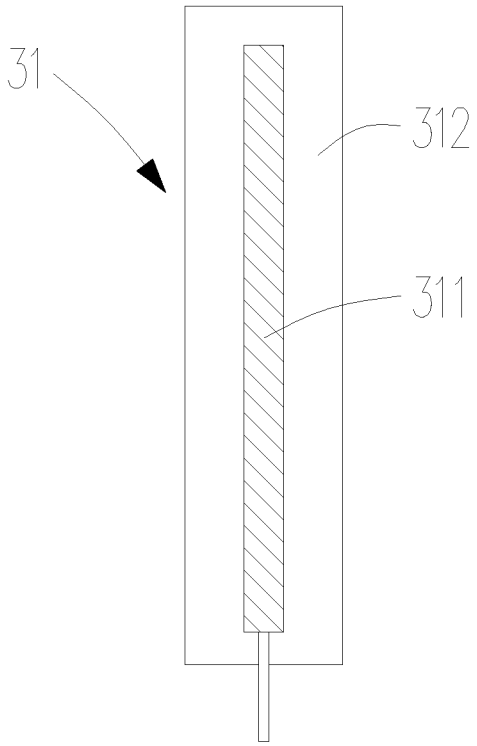
FIG. 8 is a cross-sectional view of the heater of FIG. 2.

Referring to FIG. 2 and FIG. 8, the heating assembly 30 includes two heater 31 and two electrode contacts 32 respectively connected to one of the heater 31. The heater 31 includes a heating element 311 and a thermal conductor 312 wrapped around the heating element 311. The thermal conductor 312 has good thermal conductivity and insulation, thus the temperature generated by the heating element 311 can be quickly transmitted, and can ensure the mechanical strength of the heater 31. In the embodiment, the thermal conductor 312 is made of silicon nitride or aluminum nitride. The heater 31 is in the form of a sheet.

The heating element 311 is located within the thermal conductor 312, and the heating element 311 is electrically connected to the electrode contact 32. The heating element 311 is sintered by a tungsten slurry. In this embodiment, there are four electrode contacts 32, all of which are columnar, two of which are used as positive poles and the other two are used as negative poles. One heater 31 is electrically connected to a positive pole and a negative pole. A mounting base (not shown) is provided between the heater 31 and the electrode contact 32 for fixing the heater 31 and the electrode contact 32.

It can be appreciated that, in other embodiments not shown, the number of the heaters 31 may be one, two or more, and the number of the second air guiding members 22 is one less than the number of the heaters 31, and the number of the first air guiding member 21 is always two. In this embodiment, the number of the heaters 31 is two, and therefore, the number of the second air guiding members 22 is one.

It can be appreciated that, when the number of the heaters 31 is one, the number of the second air guiding members 22 is zero, that is, the second air guiding members 22 are not provided, and the heaters 31 are disposed between the two first air guiding members 21, the two opposite sides of the heater 31 respectively cooperate with one of the first air guiding member 21 to form a first air flow passage 214.

Figure 9:
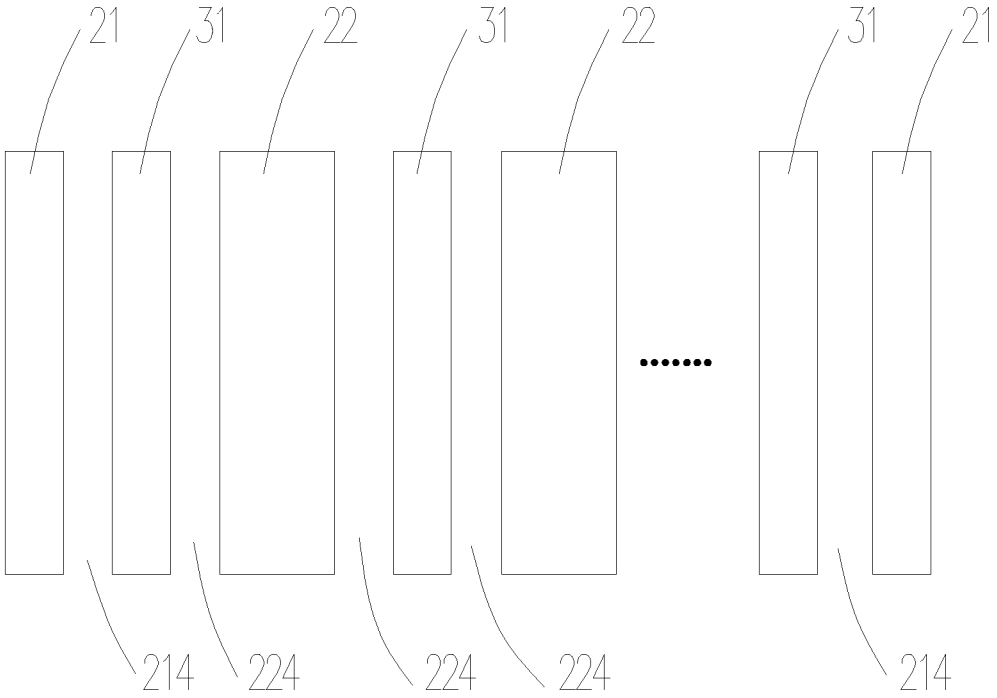
FIG. 9 is a perspective view of the air guiding assembly of the present disclosure.

As shown in FIG. 9, when the number of the heaters 31 is larger than two, the heater 31 and the second air guiding member 22 are arranged alternately, and the first air guiding members 21 are respectively disposed at one of the outermost heaters 31, and two sides of each second air guiding members 22 respectively cooperate with one heater 31 to form a second air flow passages 224. That is, the second air flow passages 224 is twice the number of the second air guiding members 22, and the two outermost heaters 31 respectively cooperate with one of the first air guiding members 21 located on the corresponding sides to form a first air flow passage 214.

The heater 31 is a heat generating piece, wherein one heater 31 is disposed between a first air guiding member 21 and a second air guiding member 22. The two side walls of the heater 31 respectively form the side walls of the first air flow passage 214 and the second air flow passage 224 which are respectively located on both sides of the heater 31. The other heater 31 is disposed between the second air guiding member 22 and the other first air guiding member 21, and the two side walls of the heater 31 respectively form the side walls of the first air flow passage 214 and the second air flow passage 224 which are respectively located on both sides of the heater 31.

The first air flow passage 214 and the second air flow passage 224 are both folded-back passages that can extend the stroke of the air and the heating time of the air within the air guiding assembly 20. The heater 31 configured as a side wall of the first air flow passage 214 and the second air flow passage 224 can directly contact the air, so that the heater 31 can directly heat the air. Such that, heat loss due to conduction of the medium can be reduced, and the air can be rapidly heated to a higher temperature.

In addition, the opposite two sides of the heater 31 constitute the side walls of the first air flow passage 214 and the second air flow passage 224, respectively, so that the surface of the heater 31 is fully utilized, and the heat generated by the heater 31 is sufficiently used to heat the air. Further, the heat insulator 12 can also be used to fix the air guiding assembly 20.

On the one hand, the number of the heat insulator 12 is two. The heat insulator 12 are respectively disposed at the upper end and the lower end of the air guiding assembly 20, to prevent the air guiding assembly 20 from sliding freely in the axial direction of the atomizer 100. On the other hand, the heat insulator 12 is sleeved outside of the air guiding assembly 20, so that the first air guiding member 21 and the second air guiding member 22 can clamp the heater 31, to prevent the first air guiding member 21, the second air guiding member 22 and the heater 31 separating from each other. The air guiding assembly 20 is fixed by the heat insulator 12 to make assembly relatively simple. During assembly, the first air guiding member 21 and the second air guiding member 22 are disposed on both sides of the heater 31, and then the first air guiding member 21 is sleeved by the heat insulator 12. Further, the air guiding plate 23 can be fixed by the heat insulator 12. Specifically, a mounting boss (not shown) protrudes inwardly from the inner wall of the housing 10 in the radial direction of the housing 10, the circumferential side of the air guiding plate 23 is sandwiched between the mounting boss and the heat insulating member.

Figure 6:
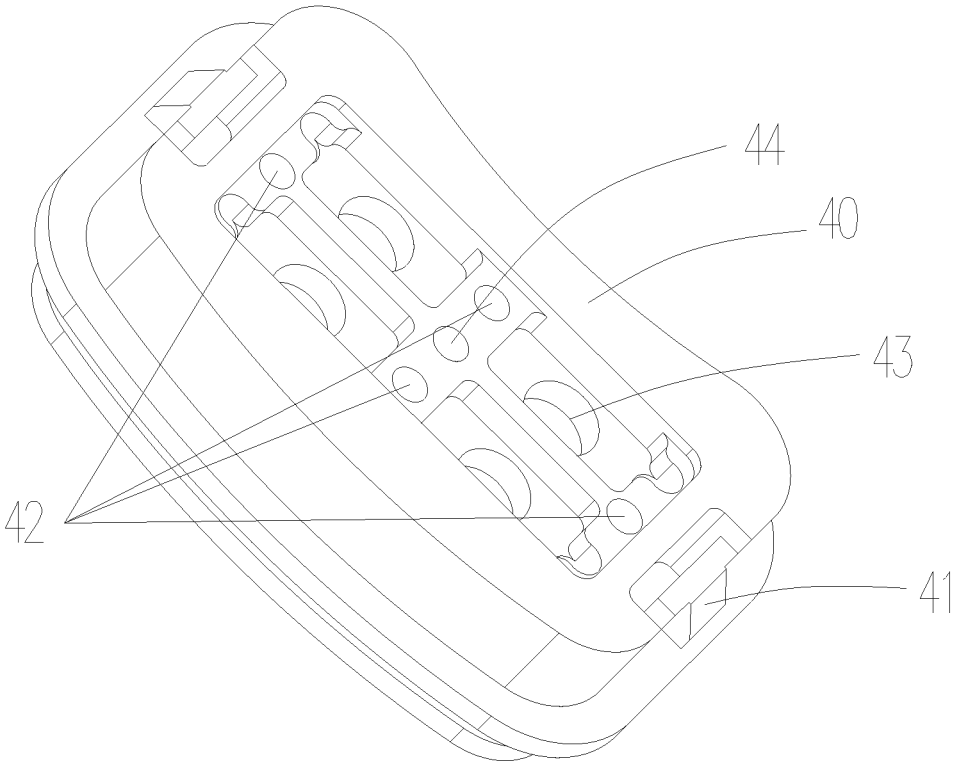
FIG. 6 is a perspective view of the base of FIG. 2.

Referring to FIG. 6, the base 40 is disposed under the air guiding assembly 20, and the base 40 is detachably connected to the housing 10. In the embodiment, the side wall of the base 40 is provided with a locking member 41 on the inner wall of the housing 10, the inner wall of the housing 10 is provided with a latching slot 13 corresponding to the locking member 41, the base 40 is engaged with the housing 10. The base 40 defines a second mounting hole 44, an air intake hole 42 and a first mounting hole 43 for mounting the electrode contact 32. The number of the air intake hole 42 is four, which are respectively corresponding to the two first air inlets 2141 and the second air inlets 2241. The second mounting holes 44 are corresponding to the positions of the installation groove 2231. One end of the temperature sensor 5 is disposed in the installation groove 2231, the other end of the temperature sensor 5 passes through the second mounting hole 44 and is electrically connected to the battery assembly. The number of the first mounting holes 43, which is corresponding to the four electrode contacts 32, is four. Each electrode contacts 32 passes through the corresponding first mounting holes 43 and is electrically connected to the battery assembly.

When the user smoking, the outside air respectively enters into the first air flow passage 214 and the second air flow passage 224 via the air intake holes 42, and then enters the atomizing chamber 11 through the air guide holes 231. The heater 31 is configured as side walls of the first air flow passage 214 and the second air flow passage 224 to directly heat the air flowing through the first air flow passage 214 and the second air flow passage 224. The hot air then enters the atomizing chamber 11 through the air guiding hole 231, and heats the tobacco in the atomizing chamber 11, such that the tobacco is heated to generate smoke for the user to use.

In the embodiment, the temperature sensor 5 is disposed in the installation groove 2231, and can detect the temperature of the second air guiding member 22 and feedback to the controller of the battery assembly. The controller stores a preset temperature. The controller compares the detected temperature of the second air guiding member 22 with the preset temperature, and control the output voltage/output power of the battery of the battery assembly to the heater 31 according to the comparison result, thereby maintaining the temperature of the second air guiding member 22 at a predetermined value.

Since the second air guiding member 22 constitutes a portion of the second air flow passage 224, the temperature of the second air guiding member 22 is equal to the temperature of the second air flow passage 224. Further, since the first air flow passage 214 and the second air flow passage 224 are heated by the same heater 31, the temperature of the first air flow passage 214 can be considered to be equal to the temperature of the second air flow passage 224. Above all, maintaining the temperature of the second air guiding member 22 at a preset temperature is equivalent to maintaining the temperature of the first air flow passage 214 and the temperature of the second air flow passage 224 at a preset temperature.

Since the first air flow passage 214 and the second air flow passage 224 are both folded-back passages, the flow stroke of the air is increased, and the heating time of the air is prolonged, so that the air has a higher temperature when it reaches the atomizing chamber 11. The hot air heats the tobacco, and the contact area between the hot air and the tobacco is more and more uniform, and the heating can be completed quickly without waiting, generating more smoke and improving the taste.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An atomizer, comprising:

a housing;

an atomizing chamber defined by an upper cavity of the housing;

a heating assembly and an air guiding assembly disposed in a lower cavity of the housing, wherein the heating assembly comprises two heaters that are planar in shape, wherein the air guiding assembly comprising two first air guiding members and one second air guiding member, wherein, when assembled, each of the two heaters are disposed between one of the two first air guiding members and the second air guiding member so as to form a first air flow passage between a first side of the heater and the first air guiding member and a second air flow passage between a second side of the heater and a second air flow passage, and wherein the first and second air flow passages are in communication with the atomizing chamber, and wherein the first air guiding member comprises a substrate, a first side plate and a second side plate disposed on the substrate, at least two first partition plates extending from the first side plate toward the second side plate and form a first gap between each first partition plate and the second side plate, at least two second partition plates extending from the second side plate toward the first side plate and form a second gap between each second partition plate and first side plate, wherein the at least two first partition plates and the at least two second partition plates are alternately arranged to form at least three pairs of adjacent first partition plate and second partition plate, each pair of adjacent first partition plate and second partition plate defines a channel therebetween, and the at least three channels are connected by a first gap and a second gap to form the first air flow passage that is interdigitized in shape.

2. The atomizer according to claim 1, wherein, during operation, a lowermost second gap serves as a first air inlet while an uppermost first gap serves as a first air outlet of the first air flow passage; or a lowermost first gap serves as the first air inlet while an uppermost second gap serves as the first outlet of the first air flow passage.

3. The atomizer according to claim 1, wherein the second air guiding member comprises a first backing plate, a second backing plate, a connecting plate connecting the first backing plate and the second backing plate, wherein the connecting plate has two lateral surfaces, each lateral surface has at least two first wall plates and at least two second wall plates disposed thereon, each of the first wall plates is connected to the first backing plate and extends towards the second backing plate and forms a third gap between each of the first wall plates and the second backing plate, each of the second wall plates is connected to the second backing plate and extends towards the first backing plate and forms a fourth gap between each of the second wall plates and the first backing plate, and the first wall plates and the second wall plates are alternately arranged to form a second air passage that is interdigitized in shape.

4. The atomizer according to claim 3, wherein, during operation, a lowermost third gap serves as a second air inlet while an uppermost fourth gap serves as a second air outlet; or a lowermost fourth gap serves as the second air inlet while an uppermost third gap serves as the second air outlet.

5. The atomizer according to claim 1, wherein each heater comprises a heating element and a thermal conductor wrapped around the heating element, wherein the thermal conductor is made of silicon nitride or aluminum nitride and the heating element is made of tungsten slurry.

6. The atomizer according to claim 1, wherein the atomizing chamber is configured to receive tobacco and, during operation, a heated air flow from the lower cavity of the housing heats the tobacco placed in the atomizing chamber.

7. The atomizer according to claim 6, wherein an air guiding plate is disposed between the upper cavity and the lower cavity of the housing, wherein the air guiding plate comprises a plurality of air guiding holes.

8. An electronic cigarette, comprising:

the atomizer of claim 1 and a battery assembly electrically connected to the atomizer.

* * * * *